US009432773B2

(12) United States Patent
Sakaguchi et al.

(10) Patent No.: US 9,432,773 B2
(45) Date of Patent: Aug. 30, 2016

(54) SPEAKER AND AUDIO-VISUAL SYSTEM

(71) Applicant: Panasonic Intellectual Property Management Co., Ltd., Osaka (JP)

(72) Inventors: Atsushi Sakaguchi, Osaka (JP); Shuji Saiki, Nara (JP); Toshiyuki Matsumura, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 14/566,704

(22) Filed: Dec. 10, 2014

(65) Prior Publication Data

US 2015/0189428 A1 Jul. 2, 2015

(30) Foreign Application Priority Data

Dec. 27, 2013 (JP) ..... 2013-271209

(51) Int. Cl.

| | |
|---|---|
| ***H04R 1/20*** | (2006.01) |
| ***H04R 9/06*** | (2006.01) |
| ***H04R 9/02*** | (2006.01) |
| *H04R 1/10* | (2006.01) |
| *H04R 9/04* | (2006.01) |
| *H04R 9/10* | (2006.01) |
| *H04R 25/00* | (2006.01) |

(52) U.S. Cl.

CPC ..... *H04R 9/06* (2013.01); *H04R 9/027* (2013.01); *H04R 1/10* (2013.01); *H04R 9/046* (2013.01); *H04R 9/10* (2013.01); *H04R 25/00* (2013.01); *H04R 2499/11* (2013.01); *H04R 2499/13* (2013.01)

(58) Field of Classification Search

CPC ..... H04R 9/06; H04R 9/027; H04R 1/10; H04R 9/046; H04R 9/10; H04R 25/00; H04R 2499/11; H04R 2499/13

USPC ..... 381/338

See application file for complete search history.

(56) References Cited

U.S. PATENT DOCUMENTS

| | | | | |
|---|---|---|---|---|
| 5,093,810 | A * | 3/1992 | Gill | G10K 11/002 367/1 |
| 2008/0152177 | A1 | 6/2008 | Watanuki et al. | |
| 2008/0240485 | A1* | 10/2008 | Dyer | H04R 1/1016 381/380 |
| 2011/0044489 | A1 | 2/2011 | Saiki et al. | |
| 2011/0235849 | A1* | 9/2011 | Takewa | H04R 9/046 381/412 |
| 2011/0293112 | A1* | 12/2011 | Harvey | H04R 1/1016 381/99 |
| 2012/0087525 | A1* | 4/2012 | Sakaguchi | H04R 7/18 381/322 |
| 2013/0148834 | A1* | 6/2013 | Seo | H04R 1/2811 381/338 |
| 2013/0329906 | A1* | 12/2013 | Harvey | H04R 3/00 381/74 |

FOREIGN PATENT DOCUMENTS

| | | |
|---|---|---|
| JP | 2008-160644 | 7/2008 |
| WO | 2009/066415 | 5/2009 |

* cited by examiner

*Primary Examiner* — Duc Nguyen
*Assistant Examiner* — Sean H Nguyen
(74) *Attorney, Agent, or Firm* — Greenblum & Bernstein, P.L.C.

(57) ABSTRACT

A speaker includes a diaphragm and a magnetic circuit, a plurality of acoustic paths that provide connection between a space formed on a side including the magnetic circuit with respect to the diaphragm and a space exterior to the speaker are formed in the magnetic circuit, and the plurality of acoustic paths include a first acoustic path and a second acoustic path that differs in acoustic impedance from the first acoustic path.

13 Claims, 11 Drawing Sheets

SPEAKER AND AUDIO-VISUAL SYSTEM

CROSS REFERENCES TO RELATED APPLICATIONS

This Application claims priority to Japanese Patent Application No. 2013-271209, filed on Dec. 27, 2013, the contents of which are hereby incorporated by reference.

BACKGROUND

1. Technical Field

The present disclosure relates to a speaker and an audio-visual system.

2. Description of the Related Art

In recent years, wideband speakers (hereinafter referred to as magnetic fluid speakers) that use divided suspensions and magnetic fluid and that are capable of reproducing low-pitched sound though being small-sized have been developed.

FIG. 10A is a diagram illustrating a cross-section of a speaker 400 that is a conventional speaker disclosed in International Publication No. 2009/066415 and that makes use of magnetic fluid and divided suspensions. FIG. 10B is a cross sectional view, taken along line XB-XB, of the speaker of FIG. 10A. The speaker illustrated in FIGS. 10A and 10B includes a yoke 20, a magnet 21, a plate 22, a diaphragm 30, suspensions 24*a* and 24*b*, a voice coil 26, a sound conduit tube H2, ribs L1, and magnetic fluid 27.

In the above configuration, the suspensions 24*a* and 24*b* that support the diaphragm 30 in a vibratable manner are provided at different positions on the periphery of the diaphragm 30. In the case where the speaker is reduced in size, accordingly, stiffness can be reduced and thus a minimum resonant frequency of the speaker can be lowered by adjusting widths and/or thicknesses of the suspensions 24*a* and 24*b*. With the sealed-in magnetic fluid 27, additionally, interference between sound waves and rolling that occur on surfaces of the diaphragm 30 can be reduced. By use of the speaker that makes use of the magnetic fluid 27 and the divided suspensions 24*a* and 24*b*, as described above, the wideband speaker though being small-sized that is capable of reproducing low-pitched sound can be provided.

Japanese Unexamined Patent Application Publication No. 2008-160644 describes an example of a hearing aid in which a damper is provided in a sound conduit tube.

SUMMARY

A speaker according to the disclosure includes a diaphragm and a magnetic circuit, a plurality of acoustic paths that provide connection between a space formed on a side including the magnetic circuit with respect to the diaphragm and a space exterior to the speaker are formed in the magnetic circuit, and the plurality of acoustic paths include a first acoustic path and a second acoustic path that differs in acoustic impedance from the first acoustic path.

According to the speaker of the disclosure, reduction in a peak due to resonance in sound pressure characteristics and holding of the sound pressure characteristics for a minimum resonant frequency or lower frequencies can be both attained, and sound waves that are excellent in reproduction of low-pitched sound and that have flat frequency characteristics can be emitted from sound conduit tubes.

DETAILED DESCRIPTION

Description will be given on matters the inventors examined for devising embodiments according to the disclosure. (Knowledge Underlying the Disclosure)

According to the conventional speaker disclosed in International Publication No. 2009/066415, a wideband speaker that is capable of reproducing low-pitched sound though being small-sized can be provided by use of the speaker that makes use of the magnetic fluid 27 and the divided suspensions 24*a* and 24*b*.

Figure 10A:
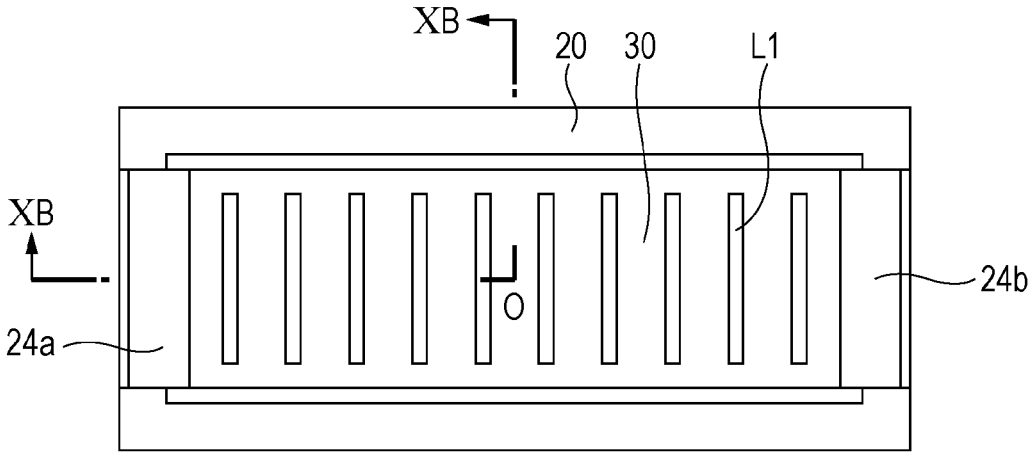
FIG. 10A PRIOR ART
FIG. 10A is a cross sectional view of a conventional speaker.
Figure 10B:
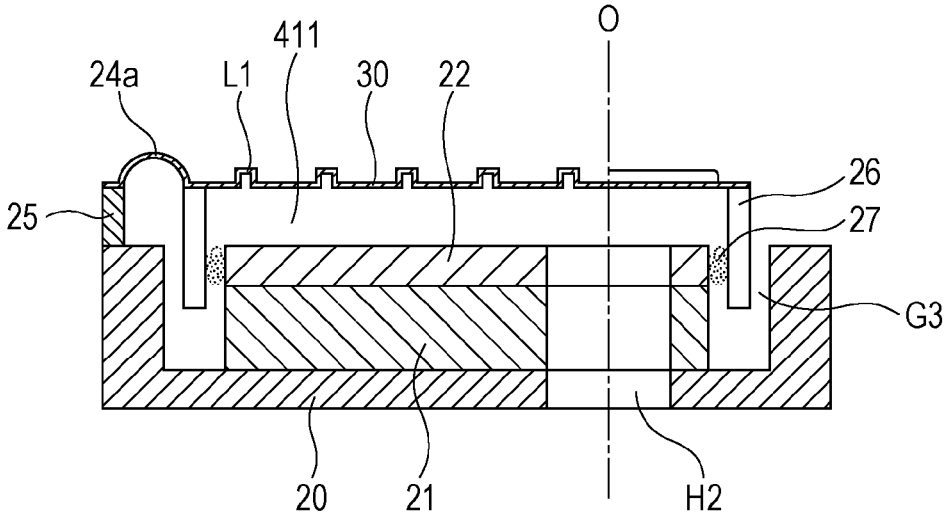
FIG. 10B PRIOR ART
FIG. 10B is a cross sectional view of the conventional speaker.

A characteristic of a system of the conventional speaker that is illustrated in FIGS. 10A and 10B and that makes use of the magnetic fluid is that sound waves are emitted through the sound conduit tube H2 to exterior space. In this system, the sound waves are emitted from the sound conduit tube H2 positioned on the back side of the diaphragm 30 and thus the diaphragm 30 can be placed inside of a device that is out of sight of a user. Accordingly, there is an advantage in that the sound waves can be reached to the user without the user noticing that the device includes the speaker.

In common speakers, a back side capacity 411 and the sound conduit tube H2 that are formed between the diaphragm 30 and the plate 22 function as a low-pass filter and it is thus difficult to reproduce a high frequency range. In magnetic fluid speakers, on the other hand, the back side capacity 411 formed between the diaphragm 30 and the plate 22 is substantially decreased by the magnetic fluid. Thus, a cutoff frequency of the low-pass filter can be increased and there is an advantage in that a higher frequency range can be reproduced in comparison with common speakers.

On condition that sound waves are emitted via the sound conduit tube H2 provided in a magnetic circuit as in the conventional speakers that make use of magnetic fluid, there is caused a problem in that occurrence of Helmholtz resonance that may be caused by the back side capacity 411 and the sound conduit tube H2 or standing wave resonance that may occur in the sound conduit tube causes formation of great peaks, degradation in sound quality, and the like. In the conventional speakers that make use of the magnetic fluid, only one sound conduit tube H2 is provided in the magnetic circuit at the center position of the speaker, and thus sound waves emitted from the center and ends of the diaphragm 30 interfere with one another because of path difference.

It is conceivable that an acoustic tube (not illustrated) is provided so as to prevent resonance from occurring on the front face (opposed to the side where the magnetic circuit is provided) of the diaphragm 30 of the speaker, for instance. In this method, however, a capacity formed between the diaphragm 30 and the acoustic tube provided on the front face of the diaphragm 30 is increased in comparison with that in a model in which the sound conduit tube H2 is provided in the magnetic circuit. Thus, the cutoff frequency of the acoustic low-pass filter formed of the space and the acoustic tube is lowered, so that a reproduction band in a high frequency range is narrowed. In addition, additional members may need to be arranged for forming a space on the front face (side opposite to the magnetic circuit) of the diaphragm 30 of the speaker, which causes increase in costs for components. For the speaker that is illustrated in FIGS. 10A and 10B and that is provided with the magnetic fluid, in particular, therefore, a structure that has a sound conduit tube provided in the magnetic circuit and that reduces the resonance and standing wave resonance that have been mentioned above is desired.

Figure 11:
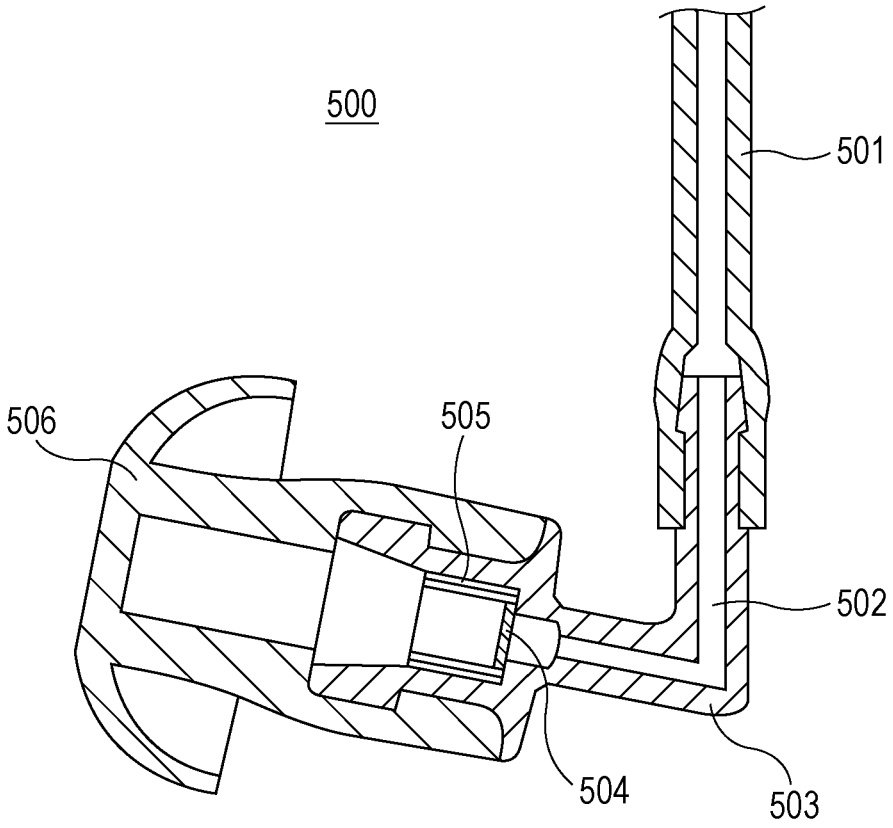
FIG. 11 PRIOR ART
FIG. 11 is a cross sectional view of a conventional sound conduit tube.

As measures against this problem, a system is conceivable in which the peak in the high frequency range is curbed by damping effect of a damper provided in the sound conduit tube as in Japanese Unexamined Patent Application Publication No. 2008-160644. FIG. 11 is a diagram illustrating a cross-section of the sound conduit tube 500 that is the conventional sound conduit tube of Japanese Unexamined Patent Application Publication No. 2008-160644 and that curbs the peak in the high frequency range by the damper. The sound conduit tube 500 includes a tube 501, a path 502, a joint 503, the damper 504, a seal member 505, and an earplug 506. In the above configuration, only by provision of the damper 504 in the joint 503, an effect is obtained in which the peak in the high frequency range that is produced in frequency characteristics of a path formed by coupling the tube 501 and the joint 503 is curbed by the damping effect of the damper 504.

Japanese Unexamined Patent Application Publication No. 2008-160644 assumes a sealed type hearing aid, an earphone, or the like that is used with an external auditory canal plugged with an earplug or the like. In the sealed type hearing aid or earphone, sound pressure characteristics for minimum resonant frequency or lower are made uniform independently of the damping effect of the damper 504, and thus provision of the damper 504 exerts no influence on low frequency characteristics.

However, even if the damper 504 illustrated in FIG. 11 is provided in the sound conduit tube H2 of the speaker illustrated in FIGS. 10A and 10B, because the speaker illustrated in FIGS. 10A and 10B is an open type speaker that emits sound waves to free space, uniform sound pressure characteristics for the minimum resonant frequency or lower are not obtained, and there is a problem in that the damping effect is also exerted on the sound pressure characteristics for the minimum resonant frequency or lower due to the provision of the damper 504, which decreases not only the peak in the high frequency range but also the sound pressure characteristics for the minimum resonant frequency or lower and degrades the sound pressure characteristics.

The speaker of the disclosure provides a speaker in which reduction in the peak due to the resonance in the sound pressure characteristics and holding of the sound pressure characteristics for the minimum resonant frequency or lower are both attained.

The speaker of the disclosure includes a diaphragm and a magnetic circuit, a plurality of acoustic paths that provide connection between a space formed on a side including the magnetic circuit with respect to the diaphragm and a space exterior to the speaker are formed in the magnetic circuit, and the plurality of acoustic paths include a first acoustic path and a second acoustic path that differs in acoustic impedance from the first acoustic path.

Thus, the reduction in the peak due to the resonance in the sound pressure characteristics and the holding of the sound pressure characteristics for the minimum resonant frequency or lower can be both attained, and sound waves that are excellent in the reproduction of low-pitched sound and that have flat frequency characteristics can be emitted from sound conduit tubes.

In the speaker of the disclosure, the magnetic circuit may be composed of a magnet, a plate, and a yoke, and the acoustic paths may be formed of at least one sound conduit tube that is provided in the magnet, the plate, and the yoke.

In such a configuration, which makes the sound conduit tube communicate with a space exterior to the speaker, pressure in a space formed between the diaphragm and the magnetic circuit does not change even when the diaphragm vibrates vertically.

In the speaker of the disclosure, a plurality of the sound conduit tubes may be provided, the speaker may include one or more dampers that cover at least one of the plurality of the sound conduit tube, the plurality of sound conduit tubes may include a first sound conduit tube that forms the first acoustic path and a second sound conduit tube that forms the second acoustic path, one of the one or more dampers may be provided on the first sound conduit tube, and any of the one or more dampers may be not provided on the second sound conduit tube.

By such a configuration, the peak due to the resonance can be curbed without the degradation in the low frequency characteristics of the speaker.

In the speaker of the disclosure, the plurality of sound conduit tubes may further include a third sound conduit tube that forms the first acoustic path and one of the one or more dampers that covers the third sound conduit tube may be provided on the third sound conduit tube.

By such a configuration, the peak due to the resonance can be curbed without the degradation in the low frequency characteristics of the speaker.

In the speaker of the disclosure, the second sound conduit tube may be placed at a substantially center position in the magnet, the plate, or the yoke, and the first sound conduit tube and the third sound conduit tube may be placed at positions symmetrical to each other with respect to the second sound conduit tube placed at the substantially center position.

By such a configuration, pressures that are exerted on the diaphragm when the speaker is activated are made symmetrical so that occurrence of unstable vibrations can be curbed.

In the speaker of the disclosure, the speaker may be in the shape of a rectangle in a top plan view, and the sound conduit tubes may be placed in a row along a direction of long sides of the speaker.

By such a configuration, sound waves emitted from the center and ends of the diaphragm can be prevented from interfering with one another because of path difference. Thus, the sound waves can be emitted without impairment in characteristics in a high frequency range that are prone to be influenced by the interference due to the path difference even though the speaker has an elongated shape.

In the speaker of the disclosure, a plurality of the sound conduit tubes may be provided, the plurality of sound conduit tubes may include the first sound conduit tube that forms the first acoustic path and the second sound conduit tube that forms the second acoustic path, and the first sound conduit tube and the second sound conduit tube may differ in radius.

By such a configuration, resistance component for the first sound conduit tube and resistance component for the second sound conduit tube can be adjusted.

In the speaker of the disclosure, a resistance component ratio for the first acoustic path and a resistance component ratio for the second acoustic path may be set to be $10^2$ or higher and $10^5$ or lower.

By such a configuration, the reduction in the peak due to the resonance in the sound pressure characteristics and the holding of the sound pressure characteristics for the minimum resonant frequency or lower are both attained.

In the speaker of the disclosure, only one sound conduit tube may be provided as the sound conduit tubes, and the first acoustic path and the second acoustic path may be formed in the sound conduit tube.

By such a configuration, the reduction in the peak due to the resonance in the sound pressure characteristics and the holding of the sound pressure characteristics for the minimum resonant frequency or lower can be both attained, and sound waves that are excellent in the reproduction of low-pitched sound and that have flat frequency characteristics can be emitted from the sound conduit tube, without providing a plurality of sound conduit tubes in the magnetic circuit.

In the speaker of the disclosure, a damper that partially covers the sound conduit tube may be provided on the sound conduit tube, sound waves emitted from the diaphragm pass through the sound conduit tube, the sound waves split into sound waves that pass thorough the damper and sound waves that pass through a portion, on the sound conduit tube, which the damper does not cover.

In such a configuration, the first acoustic path and the second acoustic path can be formed in the one sound conduit tube provided in the magnetic circuit.

In the speaker of the disclosure, magnetic fluid may be provided in a portion of the magnetic circuit.

An audio-visual system according to one aspect of the disclosure includes a television, a cellular phone, a smartphone, a tablet terminal, an earphone, a hearing aid, or a vehicle having the speaker.

Hereinbelow, embodiments of the disclosure will be described with reference to the drawings. Each embodiment that will be described below designates a preferable specific example of the disclosure. Numerical values, shapes, components, arrangement positions and connection configurations of the components, and the like that will be set forth for the embodiments below each represent an example and are not intended to limit the disclosure. The disclosure is limited by only the claims. Therefore, components that are not mentioned in the independent claims designating the most generic concept of the disclosure among the components in the following embodiments are not necessarily be demanded for resolution of the problems of the disclosure and will be described as components that configure preferred forms. The same components are provided with the same reference symbols and description thereof may be omitted. Any contents of all the embodiments may be combined.

(Embodiment 1)

Figure 1A:
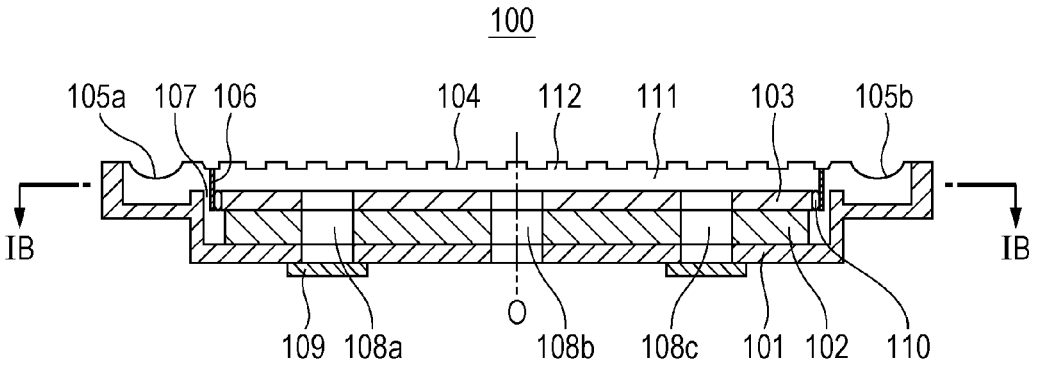
FIG. 1A is a cross sectional view illustrating an example of a speaker according to embodiment 1 of the disclosure.
Figure 1B:
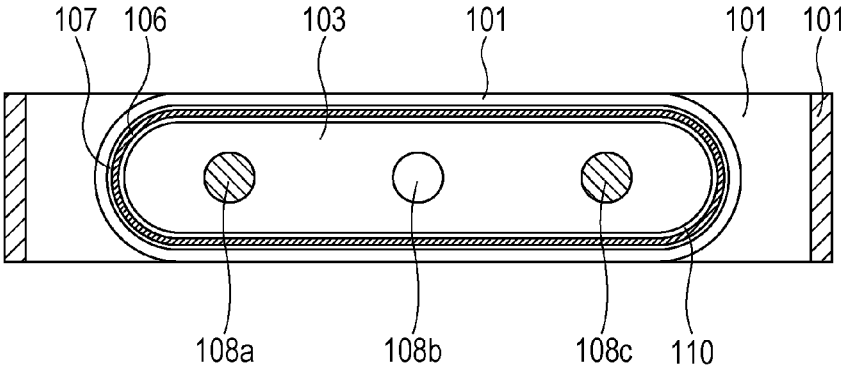
FIG. 1B is a cross sectional view illustrating the example of the speaker according to embodiment 1 of the disclosure.

FIG. 1A is a cross sectional view of a speaker 100 in the present embodiment. FIG. 1B is a cross sectional view of the speaker 100 of FIG. 1A, taken along line IB-IB. The speaker 100 includes a yoke 101, a magnet 102, a plate 103, a diaphragm 104, suspensions 105*a* and 105*b*, a voice coil 106, sound conduit tubes 108*a*, 108*b*, 108*c*, dampers 109, and magnetic fluid 110.

A magnetic circuit that defines a magnetic gap 107 is composed of the yoke 101, the magnet 102, and the plate 103. A back side capacity 111 (space on a side including the magnetic circuit with respect to the diaphragm 104) is defined by the plate 103, the diaphragm 104, the voice coil 106, and the magnetic fluid 110.

The sound conduit tubes 108*a*, 108*b*, and 108*c* are spaces that link the space on the side including the magnetic circuit with respect to the diaphragm 104 and a space exterior to the speaker 100.

The voice coil 106 and the magnetic fluid 110 are placed in the magnetic gap 107. Though FIGS. 1A and 1B illustrate an example in which ribs 112 are provided on the diaphragm 104, the ribs 112 are not essential components. Hereinbelow, components of the embodiment will be described.

The yoke 101 is shaped like a box having a top face opened and is shaped like a rectangle in a top plan view. The yoke 101 has openings on the bottom face, the openings forming portions of the sound conduit tubes 108. An open surface inside the yoke 101 has long sides in a linear shape and short sides in a curved (oval) shape. In addition, the yoke 101 includes extended parts that extend outward from the inside open surface, and the extended parts support the suspensions 105*a* and 105*b* (this will be described later). The yoke 101 is made of magnetic materials.

The magnet 102 has an oval shape in a horizontal section. That is, the oval shape is substantially the same as and smaller than the shape of the open surface inside the yoke 101. The magnet 102 has openings inside thereof and the openings form portions of the sound conduit tubes 108*a*, 108*b*, and 108*c*. The shape of the openings of the magnet 102 is the same as the shape of the openings provided on the yoke 101. The magnet 102 is bonded onto the inside bottom surface of the yoke 101 so that the openings of the magnet 102 are in alignment with the openings of the yoke 101. The magnet 102 is magnetized so that a magnetizing direction for the magnet 102 is matched with a vibration direction of the diaphragm 104.

As illustrated in FIG. 1B, the plate 103 has an oval shape in a horizontal section. That is, the oval shape is substantially the same as and smaller than the shape of the open surface inside the yoke 101. Like the yoke 101 and the magnet 102, the plate 103 has openings inside thereof and the openings form portions of the sound conduit tubes 108*a*,

108*b*, and 108*c*. The shape of the openings of the plate 103 is also the same as the shape of the openings provided on the yoke 101. The plate 103 is bonded onto the top surface of the magnet 102 so that the openings of the plate 103 are in alignment with the openings of the magnet 102. The magnetic fluid 110 is in contact with outer circumference of the plate 103. The plate 103 is made of magnetic materials.

The diaphragm 104 has an oval shape in a horizontal section. That is, the diaphragm 104 has long sides in a linear shape and short sides in a curved shape. That is, the oval shape is substantially the same as the shape of the open surface inside the yoke 101. There are no particular limitations on relative sizes of the horizontal section of the diaphragm 104 and the open surface inside the yoke 101. The diaphragm 104 is made of the same material as the suspensions 105*a* and 105*b* and is bonded with curved portions thereof formed integrally with the suspensions 105*a* and 105*b*. The diaphragm 104 does not have to be formed integrally with the suspensions 105*a* and 105*b* and does not have to be made of the same material of the suspensions 105*a* and 105*b*. The voice coil 106 is bonded to the periphery of the bottom surface of the diaphragm 104. As illustrated in FIG. 1A, a plurality of ribs 112 may be formed in parallel with the short sides of the diaphragm 104. Resonance in an audible band can be curbed by the ribs 112.

The suspensions 105*a* and 105*b* are bonded to the diaphragm 104 and the yoke 101. Sides of the suspensions 105*a* and 105*b* that are bonded to the diaphragm 104 have a curved shape. Sides of the suspensions 105*a* and 105*b* that are bonded to the yoke 101 (the extended parts thereof) have a linear shape. The suspensions 105*a* and 105*b* are integrally referred to as divided suspensions because the plurality of suspensions are bonded to only parts (short sides, curved parts) of the periphery of the diaphragm 104 without covering the entire periphery. Vertical sections of the suspensions 105*a* and 105*b* have a nonlinear shape as illustrated in FIG. 1A. The diaphragm 104 is held in a vibratable manner by the shape. The shape of the vertical sections of the suspensions 105*a* and 105*b* may be convexly downward with respect to the vibration direction as illustrated in FIG. 1A or may be convexly upward. The shape of the suspensions 105*a* and 105*b* is not limited to the above. For instance, the sides that are bonded to the yoke 101 may be in a curved shape. In this configuration, the sides of the yoke 101 that are bonded to the suspensions 105*a* and 105*b* have a curved shape, as a matter of course.

The voice coil 106 has an oval shape in a horizontal section. That is, the oval shape is substantially the same as and smaller than the shape of the open surface inside the yoke 101. The voice coil 106 is cylindrical in a three-dimensional shape. As illustrated in FIG. 1A, the upper vertical end of the voice coil 106 is bonded to the periphery of the bottom surface of the diaphragm 104. The lower vertical end of the voice coil 106 is placed in the magnetic gap 107 as illustrated in FIG. 1A. The magnetic fluid 110 is in contact with the inner circumference of the lower vertical end of the voice coil 106.

The sound conduit tubes 108*a*, 108*b*, and 108*c* are formed of the openings that are provided on the yoke 101, the magnet 102, and the plate 103 and that are in the same shape. The sound conduit tubes 108 are shaped like cylinders as illustrated in FIG. 1B. As illustrated in FIGS. 1A and 1B, the sound conduit tube 108*b* is preferably provided at a middle position (or center position) in the speaker 100, for instance. The middle position of the speaker 100 represents a middle position of the magnet 102. The middle position of the speaker 100 also represents a middle position of the plate 103. The middle position of the speaker 100 also represents a middle position of the yoke 101.

The sound conduit tube 108*b* is not necessarily required to be placed at the middle position in the speaker 100, for instance. For instance, the sound conduit tube 108*b* has only to be placed at a position (substantially middle position or substantially center position) that can be regarded as the center position of the speaker 100, the magnet 102, the plate 103, or the yoke 101, for instance.

The sound conduit tubes 108*a* and 108*c* are preferably placed at positions symmetrical to each other with respect to the sound conduit tube 108*b* (or the middle position of the speaker 100) placed at the center. FIG. 1B illustrates the example in which the sound conduit tubes 108*a*, 108*b*, and 108*c* are placed along the direction of the long sides and in which the sound conduit tubes 108*a* and 108*c* are placed at the positions symmetrical with respect to the sound conduit tube 108*b* (or the middle position of the speaker 100) along the direction of the long sides. Arrangement positions of the sound conduit tubes 108*a*, 108*b*, and 108*c*, however, are not limited to those positions.

The dampers 109 are placed in positions at which the dampers 109 cover the lower apertures of the sound conduit tubes 108*a* and 108*c*. In the speaker of FIGS. 1A and 1B, the dampers 109 are not provided on the lower aperture of the sound conduit tube 108*b*. The dampers 109 may be provided on the upper apertures of the sound conduit tubes 108*a* and 108*c*. The dampers 109 may be provided inside the sound conduit tubes 108*a* and 108*c*. The dampers 109 may be provided in such a position that the lower aperture of the sound conduit tube 108*b* is covered, instead of being provided on the lower apertures of the sound conduit tubes 108*a* and 108*c*. That is, there has only to be a configuration in which the damper 109 is provided for at least one of the plurality of sound conduit tubes 108*a*, 108*b*, and 108*c* and is not provided on the remainder.

A space on outer circumference of the plate 103 and on inner circumference of the voice coil 106 is filled with the magnetic fluid 110 so as not to include gaps.

Operations of the speaker 100 configured as described above will be described below. When electric signals are inputted into the voice coil 106, the voice coil 106 vibrates in accordance with Fleming's left-hand rule. Then, sound waves are emitted from the diaphragm 104 because the voice coil 106 is bonded to the diaphragm 104. The sound waves emitted from the diaphragm 104 pass through the sound conduit tube 108*a* and the dampers placed on or in the sound conduit tube 108*a* and are outputted to the outside of the speaker 100. On the other hand, the sound waves emitted from the diaphragm 104 pass through the sound conduit tube 108*c* and the dampers placed on or in the sound conduit tube 108*c* and are outputted to the outside of the speaker 100. Further, the sound waves emitted from the diaphragm 104 pass through the sound conduit tube 108*b* and are outputted to the outside of the speaker 100.

The suspensions 105*a* and 105*b* are partially bonded to the diaphragm 104 without covering the entire periphery of the diaphragm 104, and thus stiffness of the suspensions 105*a* and 105*b* is sufficiently lower than stiffness of a common suspension surrounding the entire periphery of a diaphragm. Accordingly, the minimum resonant frequency can be lowered and reduction in a reproduction bandwidth can be curbed. By the sound conduit tubes 108*a*, 108*b*, and 108*c*, pressure in the back side capacity 111 is kept constant even when the diaphragm 104 vibrates and thus increase in the minimum resonant frequency can be curbed.

In the speaker 100 of the embodiment, having the sound conduit tubes 108 provided in the magnetic circuit, the back side capacity 111 can be made smaller than that in a configuration in which sound conduit tubes are placed above the diaphragm 104, and the cutoff frequency of the low-pass filter is thereby shifted toward a higher frequency range, so that wideband sound waves can be emitted.

Since the sound conduit tubes 108 communicate with the exterior space, additionally, the pressure in the back side capacity 111 does not change even when the diaphragm 104 vibrates vertically and thus scattering of the magnetic fluid that may be caused by variation in the pressure in the back side capacity 111 can be curbed.

In the case where great impact on the speaker 100 makes the magnetic fluid 110 scatter in the speaker 100 and reach the sound conduit tubes 108 under capillary action, outflow of the magnetic fluid 110 to the exterior space can be curbed by absorption of the magnetic fluid 110 by the dampers 109, providing that an oil-absorbing material such as cloth is used for the dampers 109.

In the embodiment, the three sound conduit tubes 108*a*, 108*b*, and 108*c* are provided along the direction of the long sides of the rectangular speaker 100. Therefore, the sound waves emitted from the center and ends of the diaphragm 104 can be prevented from interfering with one another due to the path difference. Thus, the sound waves can be emitted without the impairment in the characteristics in the high frequency range that are prone to be influenced by the interference due to the path difference, even though the speaker 100 has the elongated shape.

In the speaker 100 of the embodiment, additionally, the dampers 109 are provided only on the sound conduit tubes 108*a* and 108*c*. That is, the dampers 109 are provided on the sound conduit tubes 108*a* and 108*c* that are placed at the positions symmetrical with respect to the sound conduit tube 108*b* (or the middle position of the speaker 100) along the direction of the long sides of the diaphragm 104. Thus, the pressures that are exerted on the diaphragm 104 when the speaker 100 is activated are made symmetrical so that the occurrence of unstable vibrations can be curbed.

In the speaker 100 of the embodiment, furthermore, the peak due to the resonance is curbed without the degradation in the sound pressure characteristics for the minimum resonant frequency or lower by design (placement) of the dampers 109 with an appropriate acoustic impedance. As described above, the dampers 109 are provided in the positions at which the dampers 109 cover the lower apertures of the sound conduit tubes 108*a* and 108*c* and are not provided on the lower aperture of the sound conduit tube 108*b*. Hereinbelow, effects of this configuration will be described.

A configuration of the speaker 100 illustrated in FIGS. 1A and 1B in which the dampers 109 are not mounted on the sound conduit tubes 108*a* and 108*c* will be referred to as configuration of the speaker without dampers.

A configuration of the speaker 100 illustrated in FIGS. 1A and 1B in which the dampers 109 are mounted also on the sound conduit tube 108*b* (configuration in which the dampers 109 are mounted on all of the sound conduit tubes 108*a*, 108*b*, and 108*c*) will be referred to as configuration of the speaker with dampers (at three sites).

Figure 2:
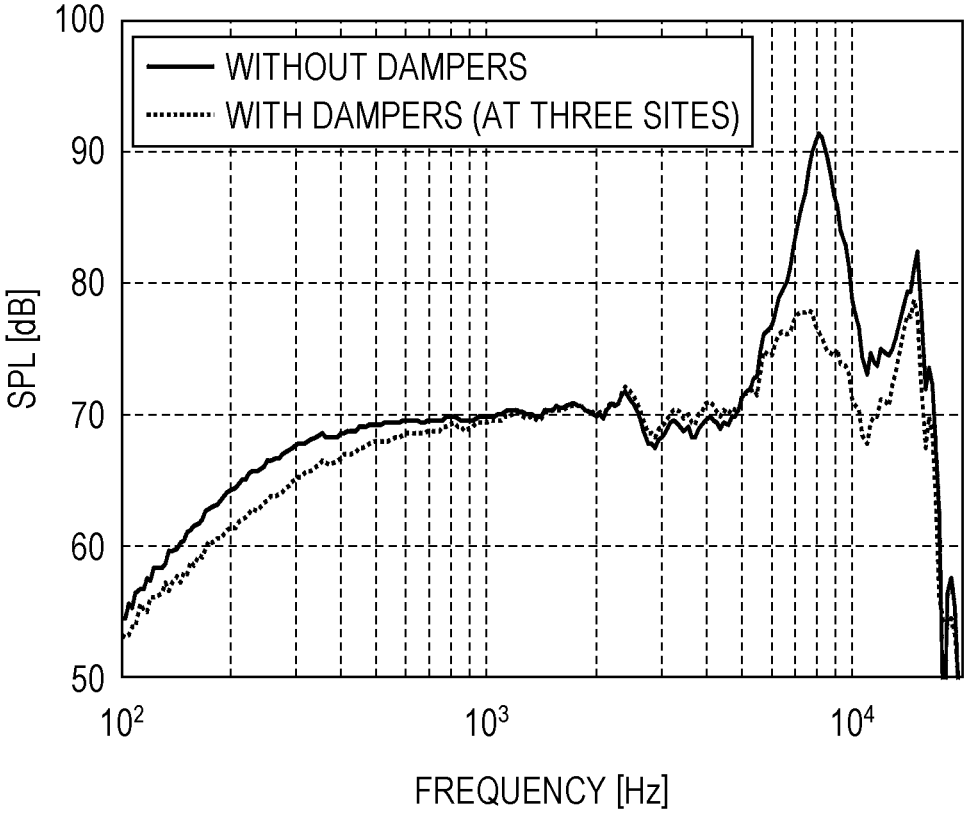
FIG. 2 is a diagram illustrating an example of a result of comparison in sound pressure frequency characteristics between the configuration of a speaker in which no damper is provided on sound conduit tubes and the configuration of a speaker in which dampers are provided on all of sound conduit tubes.

FIG. 2 illustrates a result of comparison in the sound pressure characteristics between the configuration of the speaker without dampers and the configuration of the speaker with dampers.

In FIG. 2, horizontal axis designates frequency and vertical axis designates sound pressure level. In the sound pressure characteristics of the configuration of the speaker without dampers, a peak is formed in vicinity of 8 kHz by influence of Helmholtz resonance that is caused by the back side capacity 111 and the sound conduit tubes 108. In the configuration of the speaker with dampers (at three sites), by contrast, the peak in vicinity of 8 kHz is curbed by the damping effect of the dampers 109. Concurrently, however, the sound pressure characteristics for the minimum resonant frequency or lower (1 kHz or lower) are also lowered by the damping effect of the dampers 109.

Figure 3:
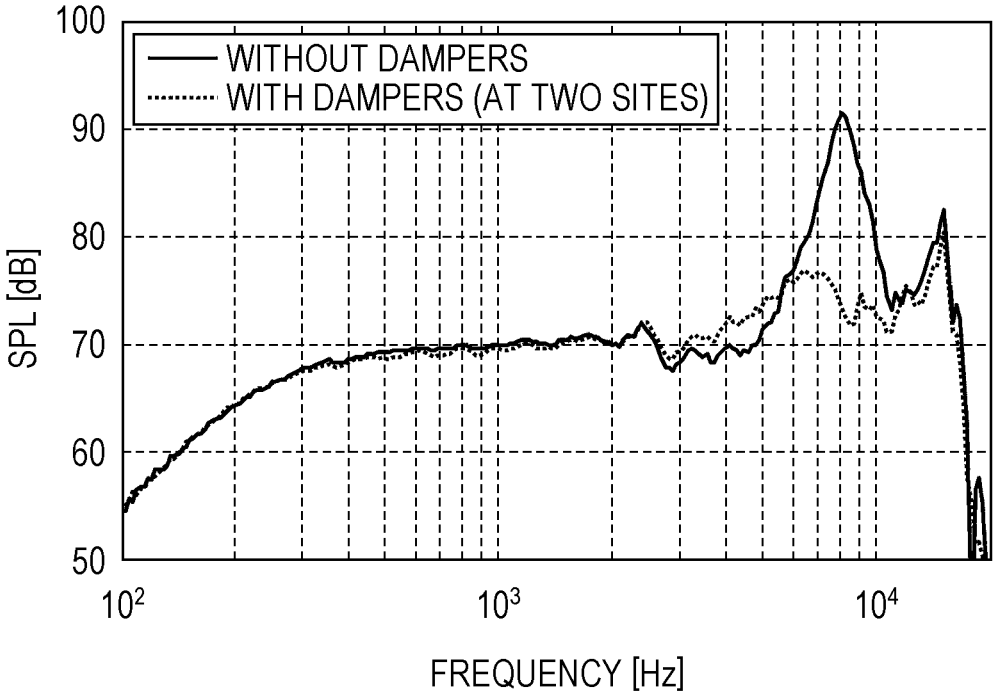
FIG. 3 is a diagram illustrating an example of sound pressure frequency characteristics relating to dampers and sound conduit tubes in embodiment 1 of the disclosure.

FIG. 3 illustrates a result of comparison in the sound pressure characteristics between the configuration of the speaker without dampers and the configuration of the speaker 100 illustrated in FIGS. 1A and 1B (the dampers 109 are placed in the positions at which the dampers 109 cover the lower apertures of the sound conduit tubes 108*a* and 108*c*). In FIG. 3, horizontal axis designates frequency and vertical axis designates sound pressure level. In the sound pressure characteristics in the configuration of the speaker with dampers (at three sites) in FIG. 2, the peak in vicinity of 8 kHz and the sound pressure characteristics for the minimum resonant frequency or lower are both decreased by influence of the dampers 109. In the speaker 100 of the embodiment, by contrast, only the peak in vicinity of 8 kHz is decreased and the sound pressure characteristics for the minimum resonant frequency or lower are equivalent to the sound pressure characteristics of the configuration of the speaker without dampers. That is, it can be observed in the sound pressure characteristics of the speaker 100 of the embodiment that the peak due to the resonance is curbed without the degradation in the low frequency characteristics.

Description will be given on reasons why the peak due to the resonance is curbed without the degradation in the sound pressure characteristics for the minimum resonant frequency or lower by provision of the two dampers 109 on two (the sound conduit tubes 108*a* and 108*c*) out of the three sound conduit tubes 108*a*, 108*b*, and 108*c*, as set forth for the embodiment.

Figure 4A:
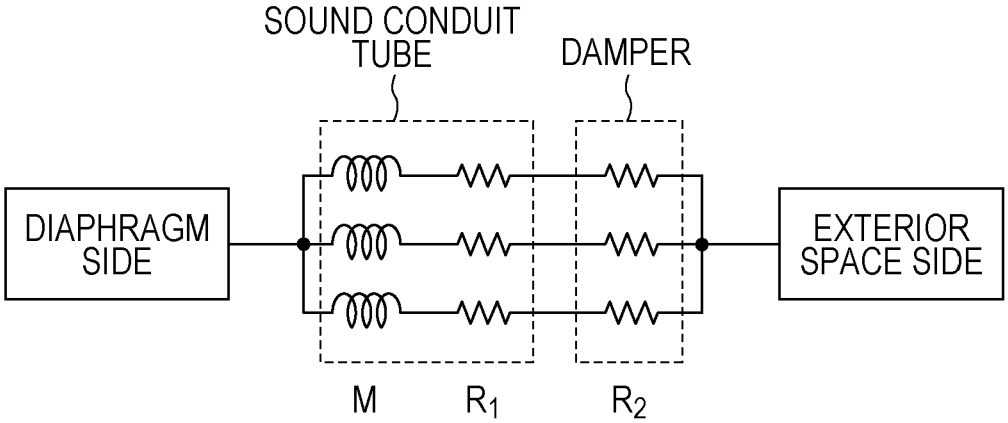
FIG. 4A is a diagram illustrating an example of an equivalent circuit corresponding to a speaker of the disclosure.
Figure 4B:
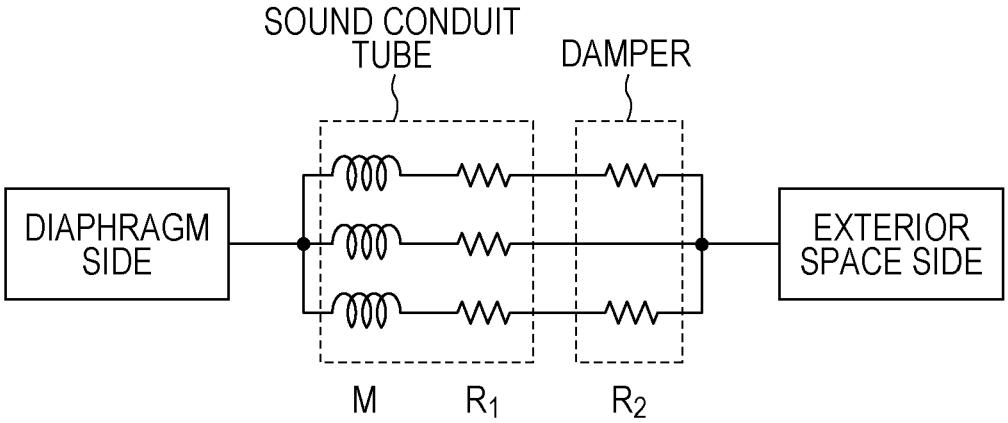
FIG. 4B is a diagram illustrating an example of an equivalent circuit corresponding to the speaker of the disclosure.

FIG. 4A is a diagram illustrating an example of an equivalent circuit in which the sound conduit tubes 108 and the dampers 109 in the configuration of the speaker with dampers (at three sites) are conceived as an acoustic impedance. FIG. 4B is a diagram illustrating an example of an equivalent circuit in which the sound conduit tubes 108 and the dampers 109 in the configuration of the speaker 100 of the embodiment are conceived as an acoustic impedance.

As an analytical approach to phenomena on occasions when the sound waves produced by the vibrations of the diaphragm 104 pass through the sound conduit tubes 108*a*, 108*b*, and 108*c*, an analytical approach to phenomena that occur on occasions when a current flows through a coil and a resistance connected in series can be applied. That is because there is a resemblance between the phenomena that occur on occasions when sound waves pass through a sound conduit tube and the phenomena that occur on occasions when a current flows through a coil and a resistance connected in series. In this relation, the sound waves may be conceived as the current and each of the sound conduit tubes 108*a*, 108*b*, and 108*c* may be conceived as the coil and the resistance connected in series.

As an analytical approach to phenomena on occasions when the sound waves pass through the dampers, an analytical approach to phenomena that occur on occasions when a current flows through a resistances can be applied. That is because there is a resemblance between the phenomena that occur on occasions when sound waves pass through a damper and the phenomena that occur on occasions when a current flows through a resistance. In this relation, the sound waves may be conceived as the current and the damper may be conceived as the resistance. Therefore, the sound conduit tubes and the dampers that are located between the space (diaphragm side) on the side including the magnetic circuit with respect to the diaphragm 104 and the space (exterior space side) exterior to the speaker can be represented as such equivalent circuits as illustrated in FIGS. 4A and 4B.

In the speaker 100 illustrated in FIGS. 1A and 1B, the sound conduit tubes 108*a*, 108*b*, and 108*c* have the same radius and the same length. In addition, the same materials are used for the dampers placed on or in the sound conduit tubes 108 and the dampers have the same thickness.

In the speaker 100 illustrated in FIGS. 1A and 1B, the sound conduit tubes 108*a*, 108*b*, and 108*c* have the same radius and the same length, and thus the acoustic impedances corresponding to the sound conduit tubes 108*a*, 108*b*, and 108*c* can be regarded as the same. In addition, the same materials are used for the dampers placed on or in the sound conduit tubes 108 and the dampers have the same thickness, so that the acoustic impedances of the dampers 109 placed on the sound conduit tubes 108*a*, 108*b*, and 108*c* in the speaker with dampers (at three sites) can be regarded as the same. In the speaker with dampers (at three sites), as illustrated in FIG. 4A, a resistance component $R_2$ of the damper 109 is added to each of the sound conduit tubes 108*a*, 108*b*, and 108*c*, and thus a real part of an acoustic impedance $Z_1$ provided by the sound conduit tube and the damper that are located between the diaphragm side and the space exterior to the speaker has a constant value independently of value of the frequency as represented by following equation (1).

$$\mathrm{Re}(Z_1) = \frac{R_1 + R_2}{3} \tag{1}$$

Strength of the damping effect is proportional to the real part of the acoustic impedance and thus concurrent reduction in the peak due to the resonance and in the sound pressure characteristics for the minimum resonant frequency or lower is caused in the configuration in which the dampers 109 are provided on all of the sound conduit tubes 108*a*, 108*b*, and 108*c*.

In the configuration in which the dampers are provided on some of the plurality of sound conduit tubes (in the positions at which the dampers cover the lower apertures of the sound conduit tubes 108*a* and 108*c*) and are not provided on the remaining sound conduit tube (sound conduit tube 108*b*), such as the speaker 100 of the embodiment illustrated in FIG. 4B, a real part of an acoustic impedance $Z_2$ between the diaphragm side and the space exterior to the speaker depends on frequency f as represented by following equation (2).

$$\mathrm{Re}(Z_2) = \frac{\{(R_1 + R_2)R_1 - (2\pi f)^2 M^2\}(3R_1 + R_2) + 3(2R_1 + R_2)(2\pi f)^2 M^2}{(3R_1 + R_2)^2 + 9(2\pi f)^2 M^2} \tag{2}$$

Provided that a ratio of a resistance component $R_1$ of the sound conduit tube itself to a resistance component $R_1+R_2$ of the sound conduit tube with addition of the damper is B, B is represented by following equation (3).

$$B = \frac{R_1 + R_2}{R_1} \tag{3}$$

Figure 5:
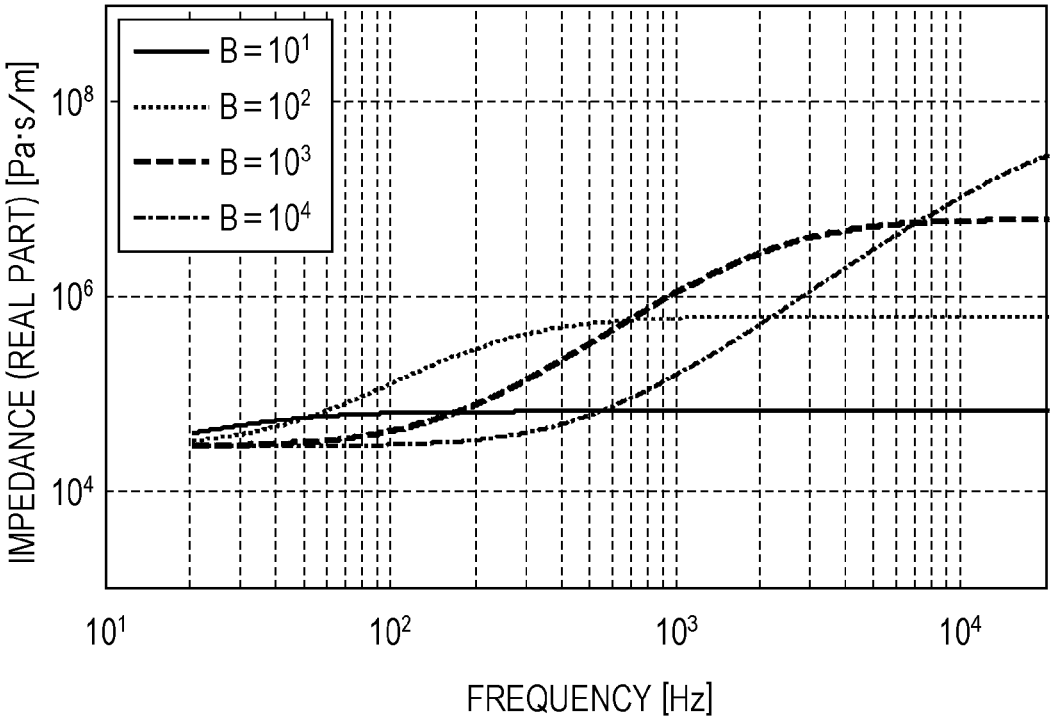
FIG. 5 is a diagram illustrating a real part of acoustic impedance characteristics ($B=10^1$ to $10^4$) relating to embodiment 1 of the disclosure.

FIG. 5 illustrates frequency characteristics of the real part of the acoustic impedance $Z_2$ under conditions of the ratios B of the resistance components of $10^1$ ($R_1$=2.81e+04, $R_2$=2.53e+05), $10^2$ ($R_1$=2.81e+04, $R_2$=2.78e+06), $10^3$ ($R_1$=2.81e+04, $R_2$=2.81e+07), and $10^4$ ($R_1$=2.81e+04, $R_2$=2.81e+08). In calculation of the real part of the acoustic impedance $Z_2$, M in equation (2) is 6.68e+02.

In FIG. 5, horizontal axis designates the frequency and vertical axis designates the value of the real part of the acoustic impedance $Z_2$.

It is observed in FIG. 5 that increase in the ratio B of the resistance components results in increase in the value of the real part of the acoustic impedance $Z_2$, chiefly, for 1 kHz or higher.

Figure 6:
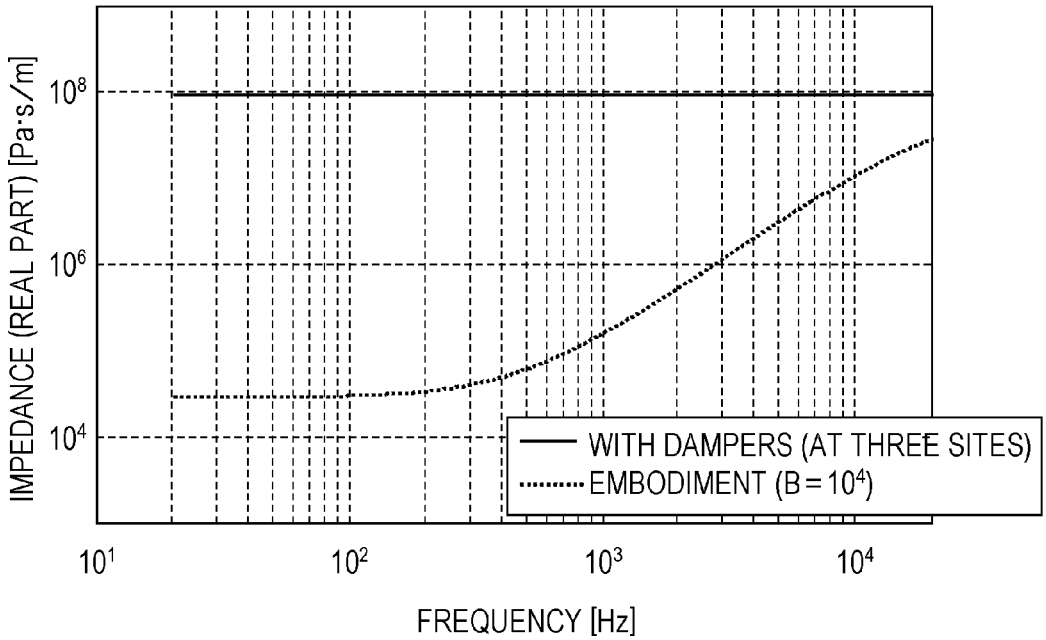
FIG. 6 is a diagram illustrating a real part of acoustic impedance characteristics in a speaker in which dampers are provided on all of sound conduit tubes and a real part of acoustic impedance characteristics corresponding to the speaker of the disclosure.

FIG. 6 illustrates a comparison between frequency characteristics of the real part of the acoustic impedance $Z_1$ between the diaphragm side and the space exterior to the speaker in the speaker with dampers (at three sites) and frequency characteristics of the real part of the acoustic impedance $Z_2$ of the speaker 100 of the embodiment under the condition of B=$10^4$ ($R_1$=2.81e+04, $R_2$=2.81e+08).

In the calculation of the real part of the acoustic impedance $Z_2$, M in equation (2) is 6.68e+02.

In FIG. 6, horizontal axis designates the frequency and vertical axis designates the value of the real part of the acoustic impedance.

In FIG. 6, the values of the real part of the acoustic impedance $Z_1$ in the configuration of the speaker with dampers (at three sites) are constant independently of the frequency, whereas the values of the real part of the acoustic impedance $Z_2$ for 1 kHz or lower in the configuration of the speaker 100 of the embodiment can be made one-fortieth or smaller of the value of the real part of the acoustic impedance at 8 kHz by setting of the ratio B of the resistance components at $10^4$.

In the speaker 100 in which the dampers are provided on at least one of the plurality of sound conduit tubes and are not provided on the remaining sound conduit tubes as in the embodiment, the peak due to the resonance thus can be curbed without the degradation in the low frequency characteristics.

Figure 7:
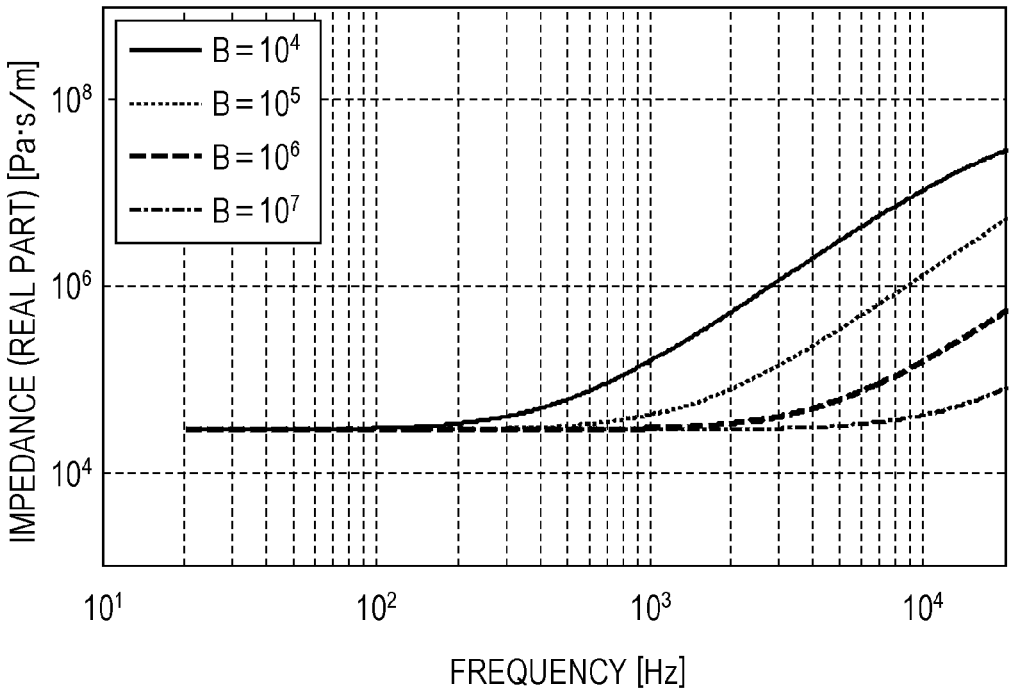
FIG. 7 is a diagram illustrating a real part of acoustic impedance characteristics ($B=10^4$ to $10^7$) relating to the speaker of the disclosure.

FIG. 7 illustrates frequency characteristics of the real part of the acoustic impedance $Z_2$ under conditions of the ratios B of the resistance components of $10^4$ ($R_1$=2.81e+04, $R_2$=2.81e+08), $10^5$ (2.81e+04, $R_2$=2.81e+09), $10^6$ (2.81e+04, $R_2$=2.81e+10), and $10^7$ (2.81e+04, $R_2$=2.81e+11).

In the calculation of the real part of the acoustic impedance $Z_2$, M in equation (2) is 6.68e+02.

In FIG. 7, horizontal axis designates the frequency and vertical axis designates the value of the real part of the acoustic impedance $Z_2$. It is observed in the drawing that the ratio B of the resistance components of $10^4$ or higher results in decrease in the value of the real part of the acoustic impedance $Z_2$ for the high frequency range. Therefore, the ratio B of the resistance components is preferably designed to be $10^2$ or higher and to be $10^5$ or lower, in order that the effects of the embodiment may be obtained.

The dampers 109 may take any arrangement positions and any shapes as long as a configuration by which paths in the sound conduit tubes 108 are blocked is provided.

Though the sound conduit tubes 108*a*, 108*b*, and 108*c* of the speaker 100 illustrated in FIGS. 1A and 1B have the same radius, there is no limitation to this configuration. For instance, the radius of the sound conduit tube 108*b* may differ from the radius of the sound conduit tubes 108*a* and 108*c*. The resistance component ($R_1$) and the ratio B of the resistance components may be adjusted by change in the radii of the sound conduit tubes 108. Decrease in the radii of the sound conduit tubes results in decrease in the ratio B of the resistance components. When the decrease in the ratio B of the resistance components is desired, accordingly, the sound conduit tubes are preferably designed to be small in the radii.

The sound conduit tube 108*b* that is illustrated in FIGS. 1A and 1B and that is not provided with the damper 109, however, chiefly conducts sounds at low frequencies. Accordingly, wind noises in the sound conduit tube 108*b* can more effectively be prevented if the radius of the sound conduit tube 108*b* is set larger than the radius of the sound conduit tubes 108*a* and 108*c*.

Providing that the dampers 109 are not used to adjust the ratio B of the resistance components, the ratio B of the resistance components can be increased by setting of the radius (or bore diameter) of the sound conduit tubes 108*a* and 108*c* smaller than the radius of the sound conduit tube 108*b*. Provided that a ratio of the radius of the sound conduit tubes 108*a* and 108*c* to the radius of the sound conduit tube 108*b* is C, C is represented by following equation (5) with use of the real part of the acoustic impedance that is represented by equation (4). In consideration of the condition of the ratio B of the resistance components, the ratio C of the radii is preferably set so as to be $10^{-1.25}$ or higher and so as to be $10^{-0.5}$ or lower.

$$Z_A = \frac{1}{\pi R^2}\left(\frac{8\mu}{R^2} + \frac{4}{3}j\omega\rho\right) \tag{4}$$

$$C = \sqrt[4]{\frac{1}{B}} \tag{5}$$

wherein $$B = \frac{\text{real part of impedance of sound conduit tube } 108a}{\text{real part of impedance of sound conduit tube } 108b} = \frac{\frac{8\mu}{\pi R_3^4}}{\frac{8\mu}{\pi R_1^4}} = \frac{R_1^4}{R_3^4} = \left(\frac{1}{C}\right)^4$$

wherein μ is viscosity coefficient ($1.86\times10^{-5}$ for air), and ρis density (1.18 kg/m$^3$ for air).

Figure 8:
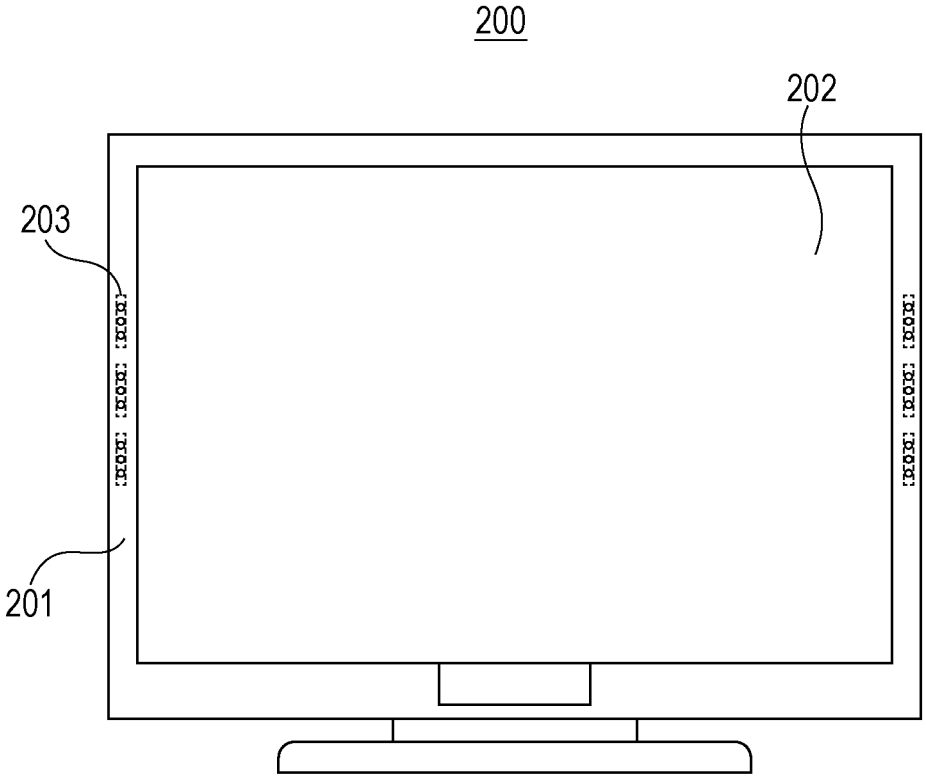
FIG. 8 is a front external view illustrating an example of a flat-screen television in which the speakers according to embodiment 1 of the disclosure are installed.

Subsequently, an example in which the speaker 100 of embodiment 1 of the disclosure is installed in a flat-screen television will be described. FIG. 8 is a front external view illustrating the example of the flat-screen television in which the speaker 100 of embodiment 1 of the disclosure is installed. In FIG. 8, reference numeral 201 denotes a housing of a set, numeral 202 denotes a display part such as liquid crystal and organic EL, and numeral 203 denotes the speakers. The speakers 203 are provided on both sides of the display part 202 in the housing of the set.

Operations in the flat-screen television configured as described above will be described below. Though not illustrated, acoustic signals processed in a signal processing unit are inputted into the speakers 203 at left and right and sounds are thereby reproduced from the speakers 203. Through agency of the damping effect of the dampers of the embodiment, sound waves emitted from the speakers 203 allow the peak due to the resonance to be curbed without the degradation in the low frequency characteristics, and sounds that are excellent in the reproduction of low-pitched sound and that have flat frequency characteristics can be reproduced.

By emission from the sound conduit tubes, the sounds can be provided to users without making the users feel presence of the speakers 100.

Though the speakers 100 are provided on both ends of the display part in the embodiment, number and arrangement positions of the speakers are not limited thereto.

Installation of the speakers 100 of the embodiment is not necessarily limited to such installation in flat-screen television as in the example of FIG. 8. The speaker may be employed in various devices that include a speaker, such as portable terminals, tablet terminals, personal computers (PC), earphones, hearing aids, and vehicles.

(Embodiment 2)

Hereinbelow, a speaker 300 of embodiment 2 will be described. For the embodiment, description on configurations similar to embodiment 1 is partially omitted.

Figure 9A:
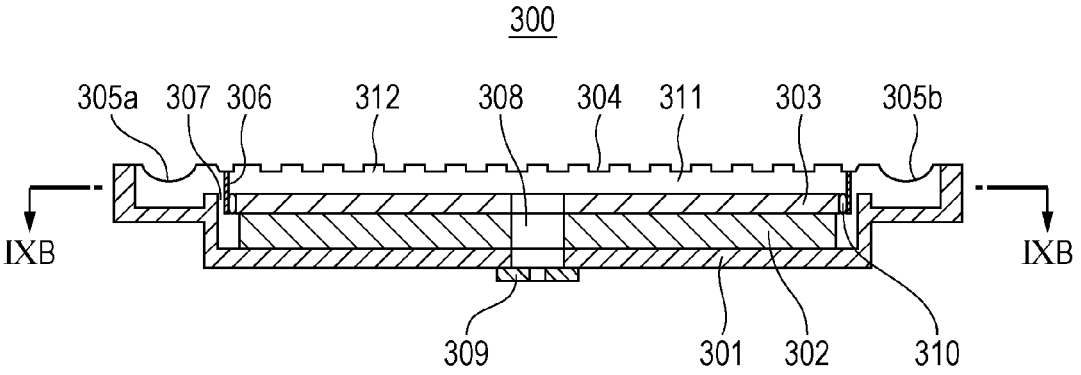
FIG. 9A is a cross sectional view illustrating an example of a speaker according to embodiment 2 of the disclosure.
Figure 9B:
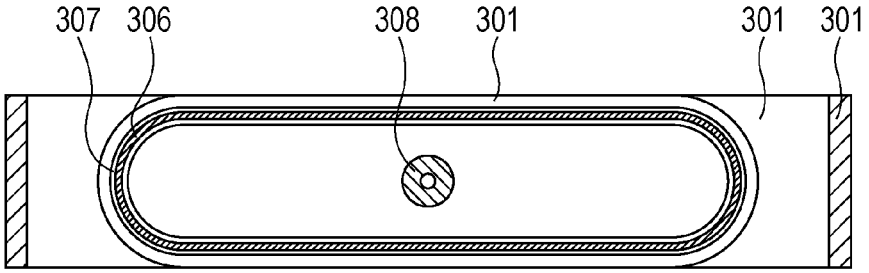
FIG. 9B is a cross sectional view illustrating the example of the speaker according to embodiment 2 of the disclosure.

FIG. 9A is a cross sectional view illustrating an example of the speaker of the embodiment of the disclosure. FIG. 9B is a cross sectional view illustrating the example of the speaker of the embodiment of the disclosure and, specifically, is the cross sectional view of the speaker of FIG. 9A, taken along line IXB-IXB.

The speaker 300 includes a yoke 301, a magnet 302, a plate 303, a diaphragm 304, suspensions 305*a* and 305*b*, a voice coil 306, a sound conduit tube 308, a damper 309, and magnetic fluid 310. A magnetic gap 307 is defined by the yoke 301, the magnet 302, and the plate 303. A back side capacity 311 is defined by the plate 303, the diaphragm 304, the voice coil 306, and the magnetic fluid 310. The voice coil 306 and the magnetic fluid 310 are placed in the magnetic gap 307. Ribs 312 may be provided on the diaphragm 304 as in embodiment 1.

Configurations in operations of the speaker 300 that are different from those of the speaker 100 of embodiment 1 will be described below.

One of the configurations that are different from embodiment 1 is provision of the single sound conduit tube 308. The one sound conduit tube 308 is provided at a center part of the speaker.

Another of the configurations that are different from embodiment 1 is incomplete closing of a section of the sound conduit tube by the damper 309. As illustrated in FIGS. 9A and 9B, a bore is provided at a center of the damper 309 (the damper 309 that is annular is used).

This embodiment is the same as embodiment 1 in that the voice coil 306 vibrates and in that sound waves are thereby generated from the diaphragm 304. A difference from embodiment 1 is addition of the annular damper 309 to the one sound conduit tube 308, as described above.

Sound waves emitted from the diaphragm 304 pass through the sound conduit tube 308. The sound waves split into sound waves that pass through the damper 309 and sound waves that pass through the center of the damper 309 (a bore provided at a middle of the damper 309) and that undergo no damping effect. Thus, an acoustic path (first acoustic path) that extends through the damper 309 and an acoustic path (second acoustic path) that does not extend through the damper 309 (or that extends through a space not covered by the damper 309, that is, the bore in the damper 309) are provided in the one sound conduit tube 308. By provision of the two acoustic paths in the one sound conduit tube 308, the peak due to the resonance can be curbed without the degradation in the low frequency characteristics as in embodiment 1. Accordingly, it is not necessary to provide a plurality of sound conduit tubes as in embodiment 1 and the effects can be attained with use of the same shape as a conventional sound conduit tube.

The damper 309 may take any arrangement position and any shape as long as a configuration by which the paths in the sound conduit tubes 308 are partially blocked is provided. A configuration in which the acoustic path that extends through the damper and the acoustic path that does not extend through the damper are formed with the damper 309 offset with respect to and bonded onto the sound conduit tube 308, for instance, and the like are conceivable.

There may be any number of sound conduit tubes and any number of sound conduit tubes to which the dampers are added, as long as desired acoustic characteristics are attained.

The sound conduit tube may have a shape, such as an oval shape, other than a circular shape, as long as the shape allows connection between the back side capacity 311 and the exterior space.

The annular damper 309 can be applied to the speaker that is illustrated in FIGS. 1A and 1B and that has the plurality of sound conduit tubes. When signals including low-frequency components in large quantities are reproduced, use of the damper 309 causes reduction in pressures exerted on the sound conduit tubes to which no dampers are added and thus curbs wind noises.

Installation of the speaker of the embodiment is not limited to installation in a flat-screen television, as is the case with embodiment 1. The speaker may be employed in various devices that include a speaker, such as portable terminals, tablet terminals, personal computers (PC), earphones, hearing aids, and vehicles.

According to the disclosure, as described above, the peak due to the resonance can be curbed without the degradation in the low frequency characteristics, and thus the speakers that are excellent in the reproduction of low-pitched sound and that have the flat frequency characteristics can be provided for televisions, tablet terminals, and smartphones for which narrowing of frame has progressed and which emit sound waves to the outside via sound conduit tubes, and for earphones and hearing aids which are of open type and which include an earplug or the like provided with vent holes.

What is claimed is:

1. A speaker comprising:
a diaphragm;
a magnetic circuit; and
a first damper,
wherein a first sound conduit tube and a second sound conduit tube, each of which provides a connection between a space formed on a side including the magnetic circuit with respect to the diaphragm and a space exterior to the speaker, are formed in the magnetic circuit,
wherein a peripheral portion of the first damper is disposed directly on a surface of the magnetic circuit so as to cover an opening of the first sound conduit tube,
wherein the first damper does not support the diaphragm,
wherein a first acoustic impedance provided by the first sound conduit tube and the first damper differs from a second acoustic impedance provided by the second sound conduit tube of which an opening is not covered by the first damper.

2. The speaker according to claim 1,
wherein each of the first sound conduit tube and the second sound conduit tube is provided in the magnet, the plate, and the yoke.

3. The speaker according to claim 2,
wherein the first sound conduit tube and the first damper form a first acoustic path and the second sound conduit tube forms a second acoustic path.

4. The speaker according to claim 3,
wherein the speaker further includes a second damper,
wherein a third sound conduit tube that provides a connection between the space formed on the side including the magnetic circuit and the space exterior to the speaker is formed in the magnetic circuit, and
wherein a peripheral portion of the second damper is directly disposed on the magnetic circuit so as to cover an opening of the third sound conduit tube.

5. The speaker according to claim 4,
wherein the second sound conduit tube is placed at a substantially center position in the magnet, the plate, or the yoke, and
wherein the first sound conduit tube and the third sound conduit tube are placed at positions symmetrical to each other with respect to the second sound conduit tube placed at the substantially center position.

6. The speaker according to claim 5,
wherein the speaker is in a shape of a rectangle in a top plan view, and
wherein the first sound conduit tube, the second sound conduit tube, and the third sound conduit tube are placed in a row along a direction of long sides of the speaker.

7. The speaker according to claim 2,
wherein the first sound conduit tube and the second sound conduit tube differ in radius.

8. The speaker according to claim 3,
wherein a ratio of a resistance component of the second sound conduit tube and a resistance component of the first sound conduit tube with the damper are set to be within a range of $10^2$ to $10^5$.

9. The speaker according to claim 1,
wherein magnetic fluid is provided in a portion of the magnetic circuit.

10. A speaker comprising
a diaphragm;
a magnetic circuit; and
a damper having a bore,
wherein a sound conduit tube that provides a connection between a space formed on a side including the magnetic circuit with respect to the diaphragm and a space exterior to the speaker is formed in the magnetic circuit,
wherein a peripheral portion of the damper is disposed on a surface of the magnetic circuit so that an opening of the damper directly contacts an opening of the sound conduit tube,
wherein the damper does not support the diaphragm,
wherein a first acoustic impedance provided by the sound conduit tube and the damper excluding the bore differs from the acoustic impedance provided by the conduit tube and the bore of the damper.

11. The speaker according to claim 10,
wherein sound waves emitted from the diaphragm pass through the sound conduit tube, and
wherein the sound waves split into sound waves that pass thorough the damper excluding the bore and sound waves that pass through the bore of the damper.

12. An audio-visual system that includes a television, a cellular phone, a smartphone, a tablet terminal, an earphone, a hearing aid, or a vehicle comprising the speaker,
wherein the speaker includes:
a diaphragm;

a magnetic circuit;

a first damper, wherein a first sound conduit tube and a second sound conduit tube, each of which provides a connection between a space formed on a side including the magnetic circuit with respect to the diaphragm and a space exterior to the speaker, are formed in the magnetic circuit, wherein a peripheral portion of the first damper is disposed directly on a surface of the magnetic circuit so as to cover an opening of the first sound conduit tube, wherein the first damper does not support the diaphragm, wherein a first acoustic impedance provided by the first sound conduit tube and the first damper differs from a second acoustic impedance provided by the second sound conduit tube of which an aperture is not covered by the first damper.

13. An audio-visual system that includes a television, a cellular phone, a smartphone, a tablet terminal, an earphone, a hearing aid, or a vehicle comprising the speaker, wherein the speaker includes:

a diaphragm;

a magnetic circuit; and a damper having a bore, wherein a sound conduit tube that provides a connection between a space formed on a side including the magnetic circuit with respect to the diaphragm and a space exterior to the speaker is formed in the magnetic circuit, wherein a peripheral portion of the damper is disposed on a surface of the magnetic circuit so that an opening of the damper directly contacts an opening of the sound conduit tube, wherein the damper does not support the diaphragm, wherein a first acoustic impedance provided by the sound conduit tube and the damper excluding the bore differs from the acoustic impedance provided by the conduit tube and the bore of the damper.

* * * * *